US005343953A

United States Patent [19]

Patel et al.

[11] Patent Number: 5,343,953

[45] Date of Patent: Sep. 6, 1994

[54] THROUGH-TUBING RECIRCULATING TOOL ASSEMBLY FOR WELL COMPLETIONS

[75] Inventors: Dhirajlal C. Patel, Carrollton; Tommy F. Grigsby, Plano, both of Tex.

[73] Assignee: Halliburton Company, Houston, Tex.

[21] Appl. No.: 110,851

[22] Filed: Aug. 24, 1993

[51] Int. Cl.[5] ..... E21B 37/04

[52] U.S. Cl. ..... 166/312; 166/237

[58] Field of Search ..... 166/51, 55, 311, 312

[56] References Cited

U.S. PATENT DOCUMENTS

| | | | |
|---|---|---|---|
| 4,030,545 | 6/1977 | Nebolsine | 166/312 X |
| 4,223,724 | 9/1980 | Levoni et al. | 166/312 X |
| 4,671,359 | 6/1987 | Renfro | 166/312 |
| 4,793,417 | 12/1988 | Rumbaugh | 166/312 |
| 4,856,590 | 8/1989 | Caillier | 166/312 X |
| 4,919,204 | 4/1990 | Baker et al. | 166/312 |
| 5,069,286 | 12/1991 | Roensch et al. | 166/312 |

*Primary Examiner*—Ramon S. Britts
*Assistant Examiner*—Frank S. Tsay
*Attorney, Agent, or Firm*—Tracy W. Druce; J. Richard Konneker

[57] ABSTRACT

A recirculating tool assembly is lowered on a length of coil tubing into the production tubing of a well completion to a location above side wall perforations in the production tubing which have become obstructed. The tool assembly includes an upper tool portion telescoped into and releasably latched within a lower sealing and tubing extension portion. Recirculating fluid is pumped down the coil tubing, flowed through a first tool assembly passage, and downwardly discharged into the production tubing. A portion of the discharged fluid is forced outwardly through the production tubing perforations to remove the obstructions therefrom, and the remainder of the discharged fluid is forced upwardly through a second tool assembly passage into the annulus between the coil tubing and the production tubing for return to the surface. After this recirculation process is completed the upper tool assembly portion is unlatched from the lower assembly portion, using fluid pressure within the coil tubing, and removed from the production tubing. An alternate embodiment of the tool assembly is used to form a gravel pack internally around additional perforations formed in the production tubing before the tool assembly is lowered into place therein. After the upper tool assembly portion is unlatched and removed, production fluid flows into the production tubing through these additional perforations and then flows into the lower portion of the tool assembly, through a sand screen structure carried thereon, for delivery to the surface.

24 Claims, 4 Drawing Sheets

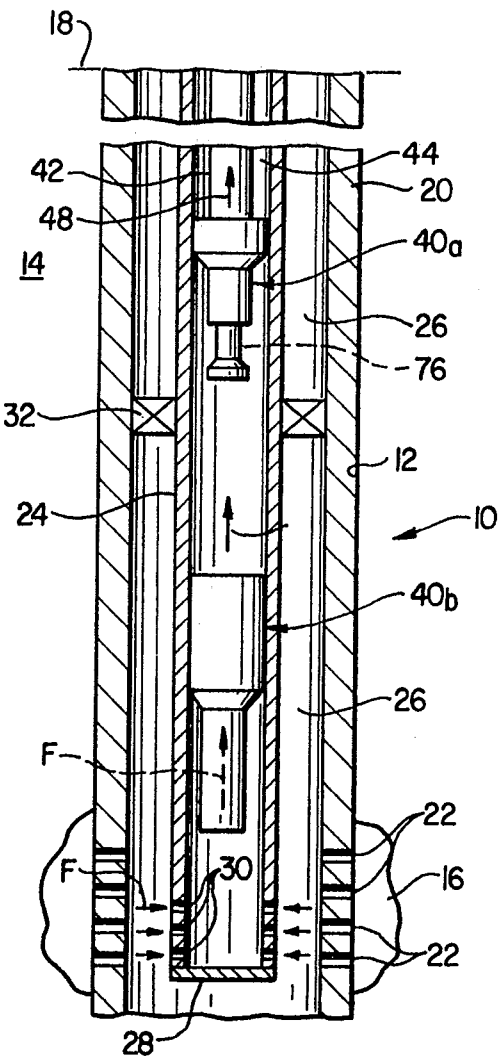
FIG. 1A
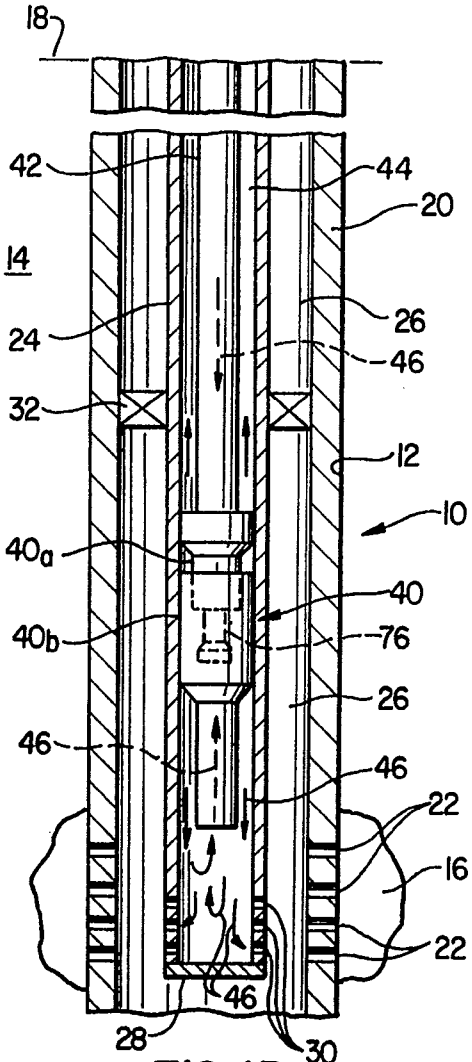
FIG. 1B
FIG. 1C

THROUGH-TUBING RECIRCULATING TOOL ASSEMBLY FOR WELL COMPLETIONS

BACKGROUND OF THE INVENTION

The present invention generally relates to the operation of subterranean wells and, in a preferred embodiment thereof, more particularly relates to the restoration of production fluid into production tubing whose production fluid inlet perforations have become obstructed.

In conventional subterranean well completions the bore hole of the well is typically lined with a tubular casing structure having perforations formed therein and disposed at a subterranean formation containing a retrievable production fluid such as gas and/or oil. Production tubing, having an outer diameter less than the inner diameter of the casing, is installed within the casing and typically has a closed lower end disposed adjacent the casing perforations. Side wall perforations are formed in the lower end of the production tubing for receiving pressurized production fluid entering the casing through the casing perforations, and an annular packer structure surrounds the production tubing, above the casing and production tubing perforations, and seals off the tubing/casing annulus above the casing and tubing perforations. Pressurized production fluid entering the production tubing through its side wall perforations is flowed upwardly through the production tubing to the surface for appropriate retrieval.

At some time during the operation of the well completion the production tubing perforations may become blocked by an obstructing material, such as sand, thereby terminating or at least substantially diminishing the desired production fluid inflow through the tubing perforations. In order to restore the production of the well completion it has heretofore been a common practice to pull the entire length of production tubing out of the casing to clear the obstructed tubing perforations, or replace the perforated tubing section, and then re-install the production tubing within the casing. As is well known, this is a laborious, time-consuming and expensive task.

It can be readily be seen that it would be highly desirable to provide an improved technique for restoring production fluid flow in a well completion under these circumstances. It is accordingly an object of the present invention to provide such an improved flow restoration technique.

SUMMARY OF THE INVENTION

In carrying out principles of the present invention, in accordance with a preferred embodiment thereof, a specially designed recirculating tool assembly is provided for use in restoring production fluid flow into a subterranean well completion production tubing structure having obstructed production fluid inlet perforations that have terminated or at least substantially reduced well production.

The assembly preferably comprises a hollow upper recirculating tool portion securable to an end of tubing means having an outer diameter smaller than the inner diameter of the production tubing, and a hollow lower sealing and tubing extension structure having support means thereon for engaging an interior portion of the production tubing and supporting the sealing and tubing extension structure at a predetermined longitudinal location within the production tubing in the vicinity of its obstructed inlet perforations upon lowering the assembly into the production tubing on the tubing means. Seal means are mounted on the assembly and are operative to engage the interior surface of the production tubing and form an annular seal around the sealing and tubing extension structure.

Latch means are provided for releasably locking the upper recirculating tool portion to the lower sealing and tubing extension structure. A first wall means portion of the assembly defines a first flow path through which a fluid within the tubing means may be flowed downwardly through the assembly and discharged therefrom, and a second wall means portion of the assembly defines a second flow path, isolated from the first flow path, through which a portion of the discharged fluid may be returned upwardly through the assembly and upwardly discharged therefrom. Fluid pressure operable means are disposed in the first flow path and are operable to unlock the latch means and free the upper recirculating tool portion from the lower sealing and tubing extension structure.

Under one production flow restoration method of the invention the recirculating tool assembly is lowered into the production tubing, on the lower end of the tubing means (representatively a length of coil tubing), until the support means portion of the assembly comes to rest on an internal "no-go" shoulder portion of the production tubing. A recirculation fluid is then pumped down the coil tubing and through the first assembly flow path, and then is downwardly discharged into the production tubing below the assembly. A portion of the discharged fluid is forced outwardly through the obstructed production tubing perforations, thereby unblocking them. The balance of the discharged fluid is forced upwardly through the second assembly flow path and is discharged through the upper end of the assembly, into the annulus between the coil tubing and the production tubing, for return to the surface.

When this recirculation/perforation clearing process is completed, fluid pumped downwardly through the coil tubing is used to operate the fluid pressure operable means to unlatch the upper recirculating tool portion from the lower sealing and tubing extension structure, and the recirculating tool portion is pulled out of the production tubing on the coil tubing leaving the lower sealing and tubing extension structure in place within the production tubing. Production fluid may then flow inwardly through the now unblocked tubing perforations and upwardly through the sealing and tubing extension structure and the production tubing to restore well production.

The use of the recirculating tool assembly of the present invention thus advantageously avoids the conventional necessity of pulling and then reinstalling the entire production tubing string to correct for its obstructed inlet perforations. Alternately, if desired, the tool portion may be left in its latched relationship with the sealing and tubing extension structure, and the entire assembly pulled out of the production tubing on the coil tubing.

Under another production flow restoration method of the invention, the lower sealing and tubing extension structure has installed therein a perforated tubing section outwardly circumscribed by an annular sand screen structure. Prior to lowering this modified recirculating tool assembly into the production tubing additional inlet perforations are formed in the production tubing, representatively above the obstructed perforations. These additional inlet perforations may be formed using, for example, a conventional perforating gun lowered into the production tubing and then removed therefrom after the additional perforations are formed.

After the modified assembly is lowered into place within the production tubing a fluid/gravel pack material slurry is forced downwardly through the first assembly flow path to form a gravel pack structure having a portion disposed between the sand screen and the previously formed additional production tubing inlet perforations, with a fluid portion of the discharged slurry being recirculated upwardly through the second assembly flow path. After this gravel pack has been formed, the upper recirculating tool portion is unlatched from the lower sealing and tubing extension structure and removed from the production tubing. Production fluid may then flow inwardly through the new tubing perforations, the sand screen structure and the perforated tubing section of the sealing and tubing extension structure, and upwardly through the sealing and tubing extension structure into the production tubing for delivery upwardly therethrough to the surface.

BRIEF DESCRIPTION OF THE DRAWINGS

FIGS. 1A–1C are schematic, vertically foreshortened cross-sectional views through a representative subterranean well completion and illustrate the use of a through-tubing recirculating tool of the present invention to restore production fluid inflow through the production tubing portion of the well after inlet perforations in the production tubing have become blocked;

DETAILED DESCRIPTION

Figure 2A:
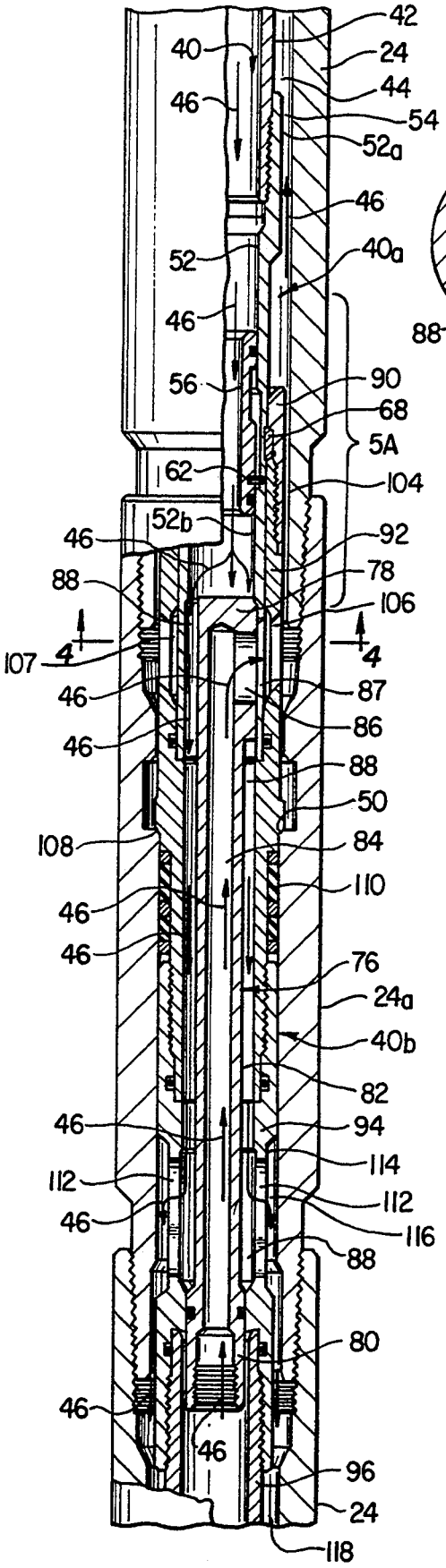
FIGS. 2A–2C are enlarged scale cross-sectional views, partly in elevation, of vertically successive longitudinal portions of the recirculating tool assembly and the production tubing surrounding it.

Cross-sectionally illustrated in schematic form in FIGS. 1A–1C is a representative subterranean well completion 10 having a bore hole 12 that extends downwardly through the earth 14 through a production fluid bearing formation 16 disposed beneath the earth's surface 18. Bore hole 12 is conventionally lined with a tubular metal casing structure 20 having production fluid inflow perforations 22 suitably formed therein at the formation 16. A length of smaller diameter production tubing 24 concentrically extends downwardly through the casing 20 and defines therewith an annular space 26 laterally surrounding the production tubing.

The bottom end of the production tubing 24 is closed off, as at 28, and is vertically adjacent the casing perforations 22. Production fluid side wall inlet perforations 30 are formed in a lower end portion of the production tubing above its closed bottom end 28 in the region of the casing perforations 22. An annular packer structure 32 disposed above the casing and tubing perforations 22 and 30 circumscribes the production tubing 24 and seals off the casing annulus 26 in a manner preventing production fluid flow through the annulus upwardly past the packer 32.

During normal operation of the well completion 10 pressurized production fluid from the subterranean formation 16 flows inwardly through the casing and tubing perforations 22 and 30 and flows upwardly through the production tubing 24 to the surface 18 into a suitable receiving structure. At some time during the productive life of the well completion the tubing perforations 30 may become blocked by well debris, such as sand 34 as indicated in FIG. 1A, thereby terminating or at least greatly reducing the desired upflow of production fluid through the tubing 24. It is to this problem that the present invention is directed.

Turning now to FIG. 1B, to restore the upflow of production fluid through the tubing 24 the present invention provides a specially designed through-tubing recirculating tool assembly 40 which may be lowered into place within the production tubing 24, above its side wall perforations 30, on a length of ordinary coil tubing 42. As illustrated, the coil tubing 42 has an external diameter than the internal diameter of the production tubing 24. Accordingly, an annular space 44 is formed between the coil tubing and the production tubing above the tool assembly 40.

The recirculating tool assembly 40 has a generally tubular configuration and includes an upper portion in the form of a recirculating tool **40*a* that is suitably anchored to the lower end of the coil tubing 42, and a lower portion in the form of a sealing and tubing extension structure 40*b*. The recirculating tool 40*a* is telescopingly received within the sealing and tubing extension structure 40*b*** and is releasably locked thereto by means of a fluid pressure operable latch mechanism subsequently described herein.

After the recirculating tool assembly 40 has been lowered into place within the production tubing 24 a suitable recirculating fluid 46 (such as water or a brine solution) is pumped downwardly through the coil tubing 42. As schematically illustrated in FIG. 1B, and subsequently described in greater detail herein, the recirculating fluid 46 is forced downwardly through a first passage portion of the recirculating tool assembly 40, exits the tool assembly through a laterally peripheral portion thereof, and is forced into the production tubing interior portion beneath the tool assembly.

A portion of this discharged recirculating fluid 46 is forced outwardly through the production tubing inlet perforations 30, thereby clearing away the sand 34 or other obstructing material blocking the perforations 30. The balance of the discharged fluid 46 is recirculated upwardly through a second passage portion of the recirculating tool assembly 40 and is discharged into the coil tubing annulus 44 for return therethrough to the surface 18.

After this recirculating, perforation-clearing process is completed, the previously mentioned internal latch mechanism within the recirculating tool assembly 40 may be operated to release the recirculating tool **40*a* from the sealing and tubing extension structure 40*b*, thereby permitting the recirculating tool 40*a* to be upwardly removed from the sealing and tubing extension 40***b*, and pulled out of the production tubing 24 on the coil tubing 42 as indicated by the arrow 48 in FIG. 1C, leaving the sealing and tubing extension structure 40*b* in place within the production tubing 24. The now cleared production tubing side wall perforations 30 again permit inflow therethrough of production fluid F. The pressurized production fluid F entering the interior of the production tubing 24 beneath the remaining sealing and tubing extension structure 40*b*, as also indicated in FIG. 1C, flows upwardly through the sealing and tubing extension structure 40*b* for delivery through the production tubing 24 to the surface 18, thereby restoring normal production fluid flow through the repaired well completion 10.

Structure of the Recirculating Tool Assembly 40

With reference to FIGS. 2A–2C and 4–6, the overall structure of the recirculating tool assembly 40 will now be described in detail. It should first be noted that a conventional nipple section 24*a* (see FIG. 2A) is installed in the production tubing 24, at a predetermined distance above the production tubing perforations 30, and has an annular no-go internal shoulder portion 50 within its interior. In a manner subsequently described, when the circulating tool assembly 40 is lowered into place within the production tubing 24 it comes to bear against and rests upon the shoulder portion 50.

Referring now to FIGS. 2A, 4, 5A and 6, the recirculating tool 40*a* includes a hollow tubular round box member 52 having an internally threaded upper end portion 52*a* into which the lower end of the coil tubing 24 is threaded, and a reduced diameter lower end portion 52*b*. The outer diameter of the upper end portion 52*a* is somewhat smaller than the inner diameter of the production tubing 24, thereby creating an annular space 54 around the upper end portion 52*a*.

A hollow, open-ended tubular piston member 56 is coaxially disposed within the lower end portion 52*b* of the member 52 and is slidingly sealed thereto by O-ring seals 58,60 respectively carried on the upper and lower ends of the piston 56. A circumferentially spaced plurality of shear pins 62 (only one of which is visible in the drawings) positioned immediately above the lower piston seal 60 releasably anchor the piston 56 to the lower end portion 52*b* of the round box member 52. For purposes later described, an annular exterior surface recess 64 is formed in the piston 56, between the shear pins 62 and the upper piston seal 58, with a lower end portion of the recess 64 facing and downwardly overlapping an annular interior surface recess 66 formed in the lower end portion 52*b* of the round box member 52.

Figure 6:
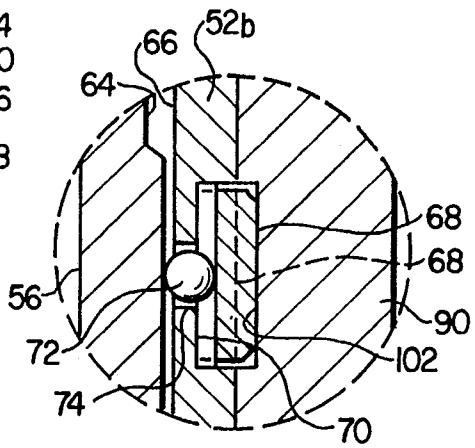
FIG. 6 is an enlargement of the dashed line area 6 of the recirculating tool assembly shown in FIG. 5A.

The previously mentioned fluid pressure operable internal latch structure of the recirculating tool assembly 40, which releasably anchors the recirculating tool 40*a* to the sealing and tubing extension structure 40*b*, includes a split annular lug member 68 having an inner side portion received in an annular exterior surface notch 70 on the lower round box end portion 52*b*, and an outer side portion projecting radially outwardly beyond the outer side surface of the box end portion 52*b* (see FIG. 6).

In its radially relaxed position the split annular lug 68 is configured to be received in the notch 70 in a manner such that the lug does not appreciably project outwardly beyond the exterior side surface of the lower box end portion 52*b*. However, in the latching position of the lug 68 illustrated in FIGS. 5A and 6 the lug is radially expanded by a circumferentially spaced series of small metal balls 72 (only one of which is shown) received in corresponding holes 74 extending inwardly through the interior side surface of the annular notch 70. Radially outer sides of the balls 72 bear against the inner side surface of the lug 68, with radially inner sides of the balls 72 bearing against the outer side surface of the piston 56 below its annular exterior side surface recess 64.

Figure 4:
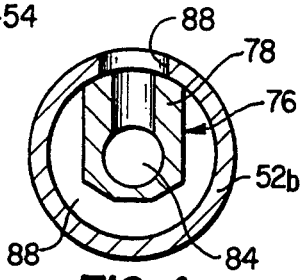
FIG. 4 is an enlarged scale cross-sectional view through a flow sub portion of the recirculating tool assembly taken along line 4—4 of FIG. 2A.

The recirculating tool 40*a* also includes an elongated flow sub member 76 having a transversely enlarged upper end portion 78, a transversely enlarged cylindrical lower end portion 80, and an elongated body portion 82 extending between end portions 78 and 80. The upper end portion 78 of the flow sub 76 is received within and welded to the lower end portion 52*b* of the round box member 52. A vertical flow passage 84 extends upwardly through the lower end 80 of the flow sub 76 and through its body portion 82, and opens outwardly through a transverse passage portion 86 formed in the upper flow sub end portion 78 and communicated with a side wall opening 87 formed in the lower round box end portion 52*b*. As illustrated in FIGS. 2A and 4, along its length the flow sub 76 is cross-sectionally smaller than the interior of the lower box end portion 52*b*. Accordingly, a flow passage 88 is formed within the lower box end portion 52*b* around the exterior side surface of the flow sub 76.

The sealing and tubing extension structure 40*b* is basically an elongated, open ended tubular structure formed from a series of threaded-together longitudinal tubing sections comprising, from top to bottom, the tubing sections 90, 92, 94, 96, 98 and 100. Tubing section 90 has an annular interior side surface notch 102 that receives an outer side surface portion of the lug 68 (see FIG. 6), thereby releasably locking the recirculating tool 40*a* to the sealing and tubing extension structure 40*b*.

An annular flow passage 104 is formed between the interior surface of the production tubing 24 and the outer side surfaces of the tubing sections 90 and 92 and communicates with a circumferentially spaced series of slots 106 formed through the tubing section 92. Slots 106, in turn, communicate with the transverse flow sub passage 86 through the box member slot 87 and an annular space 107 formed between the tubing section 92 and the round box portion 52*b*.

An annular exterior side surface shoulder 108 is formed on the tubing section 92 and, when the recirculating tool assembly 40 is lowered into the production tubing 24, downwardly engages and is stopped by the internal no-go shoulder 50 on the production tubing section 24*a* which supports the lowered recirculating tool in place within the production tubing 24. Immediately below the shoulder 108 is an annular V-pack seal structure 110 that circumscribes the tubing section 92 and sealingly engages the interior side surface of the production tubing 24.

Figure 2B:
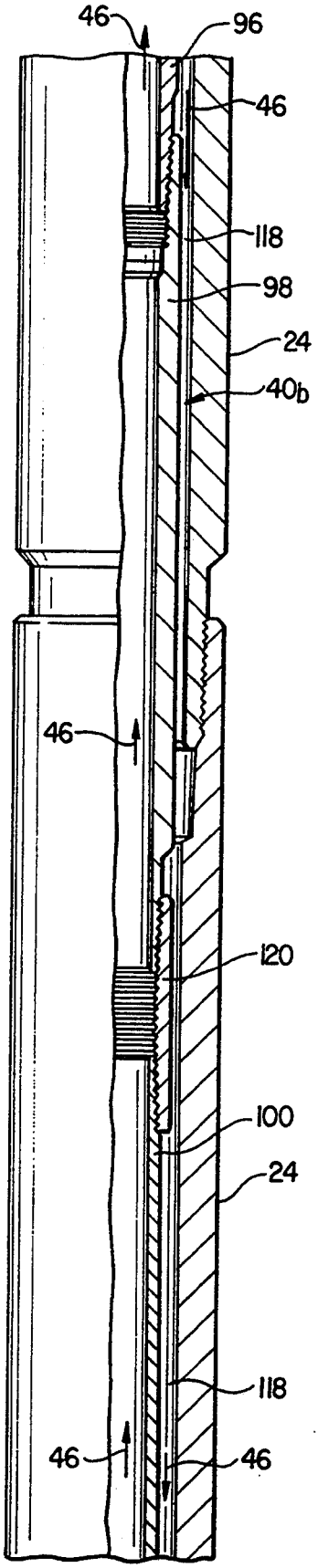
Figure 2C:
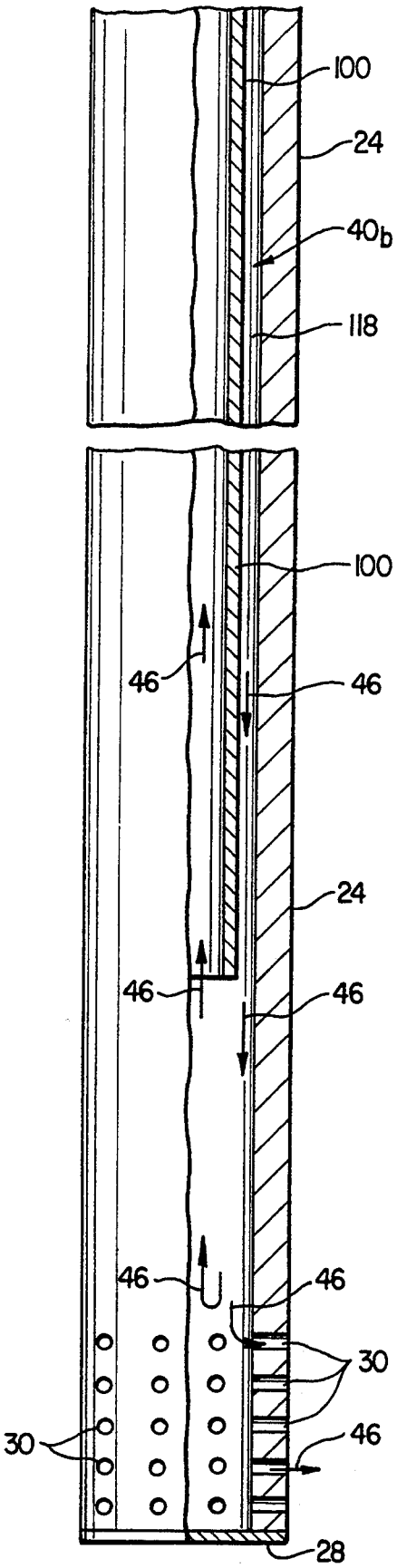

A vertically intermediate portion of the tubing section 94 defines with the flow sub body portion 82 a downward continuation of the flow passage 88 which opens outwardly through a circumferentially spaced series of side wall slots 112 formed through a radially reduced portion 114 of the tubing section 94. Radially reduced portion 114 forms with the interior side surface of the production tubing section 24*a* an annular flow passage 116 that extends downwardly past the enlarged lower end portion of the tubing section 94 and opens into an annular flow passage 118 that circumscribes the tubing sections 96, 98 and 100 as illustrated in FIGS. 2B and 2C. The lowermost tubing section 100 has an open lower end and may be a single length of tubing or a plurality of tubing sections joined by conventional collar joints such as the collar joint 120 shown in FIG. 2B.

Use of the Recirculating Tool Assembly 40

Referring now to FIGS. 2A–2C, when the recirculating tool assembly 40 is lowered into the production tubing 24 on the coil tubing 42, as it approaches the blocked tubing perforations 30 it is stopped by and comes to rest on the internal production tubing shoulder 50 that upwardly engages the annular external shoulder 108 on the seal and tubing extension structure **40*b*. The circulating fluid 46 is then pumped downwardly through the coil tubing 42 and downwardly through and around the supported recirculating tool assembly 40 via a fluid supply flow path that, from top to bottom, sequentially comprises the interiors of the round box member 52 and the piston 56; the flow passage 88 around the flow sub 76; the side wall slots 112; the annular flow passage 116; and the annular flow passage 118**.

As previously described, and as illustrated in FIG. 2C, a portion of the circulating fluid 46 downwardly discharged from the recirculating tool assembly is forced outwardly through the blocked tubing perforations 30, to clear them, and the remainder of the fluid is recirculated upwardly to the surface. This recirculated fluid 46 is forced upwardly through and around the recirculating tool assembly 40, into the coil tubing annulus 44, via a fluid recirculating flow path that, from bottom to top, sequentially comprises the interiors of the tubing sections 100, 98 and 96; the interior flow sub member passage 84; the transverse flow sub passage 86; the box member slot 87; the annular space 107; the slots 106 in tubing section 92; the annular passage 104 around the upper tubing section 90; and the annular space 54 around the upper round box member end **52*a***.

After this fluid recirculation process has been completed, the recirculating tool **40*a* may be unlatched from the sealing and tubing extension structure 40*b* in the following manner which will be described in conjunction with FIGS. 5A, 5B and 6. To effect the unlatching of the recirculating tool 40*a* from the sealing and tubing extension structure 40*b*, a metal ball 122 is dropped into the coil tubing 42 and fluid 46 is pumped downwardly through the coil tubing. The ball 122 comes into sealing engagement with the open top end of the piston 56 (see FIG. 5A), thereby preventing downward flow of the fluid 46 through the piston. Continued pumping of the fluid 46 elevates the downward fluid pressure force on the ball 122, and thus the piston 56, until the shear pins 62** break as depicted in FIG. 5B.

Figure 5B:
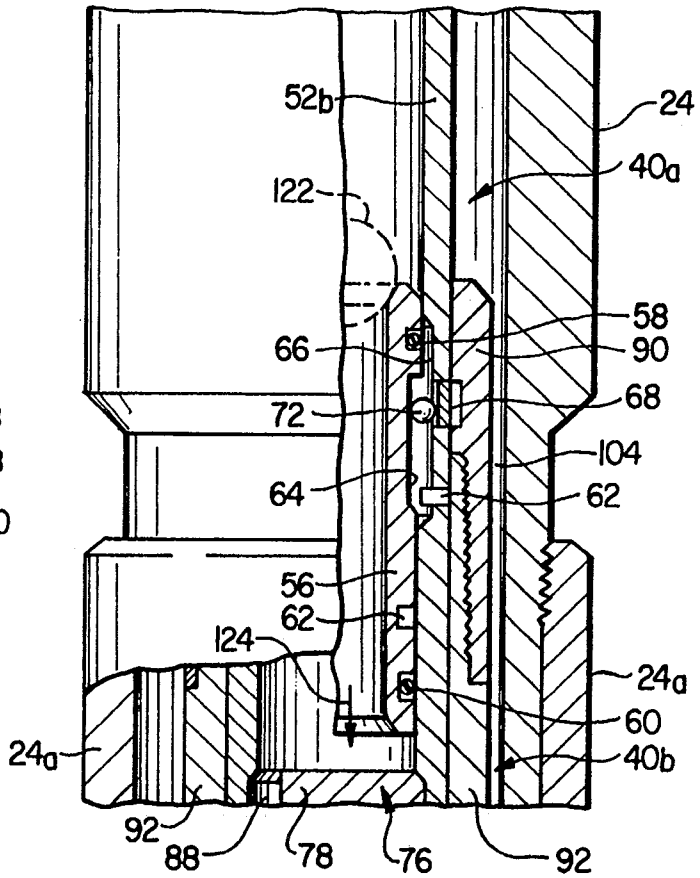
FIGS. 5A and 5B are enlarged scale partly elevational cross-sectional views through the bracketed longitudinal portion 5 of the recirculating tool assembly depicted in FIG. 2A and illustrate the operation of a fluid pressure operable latch mechanism within the recirculating tool assembly.
Figure 5A:
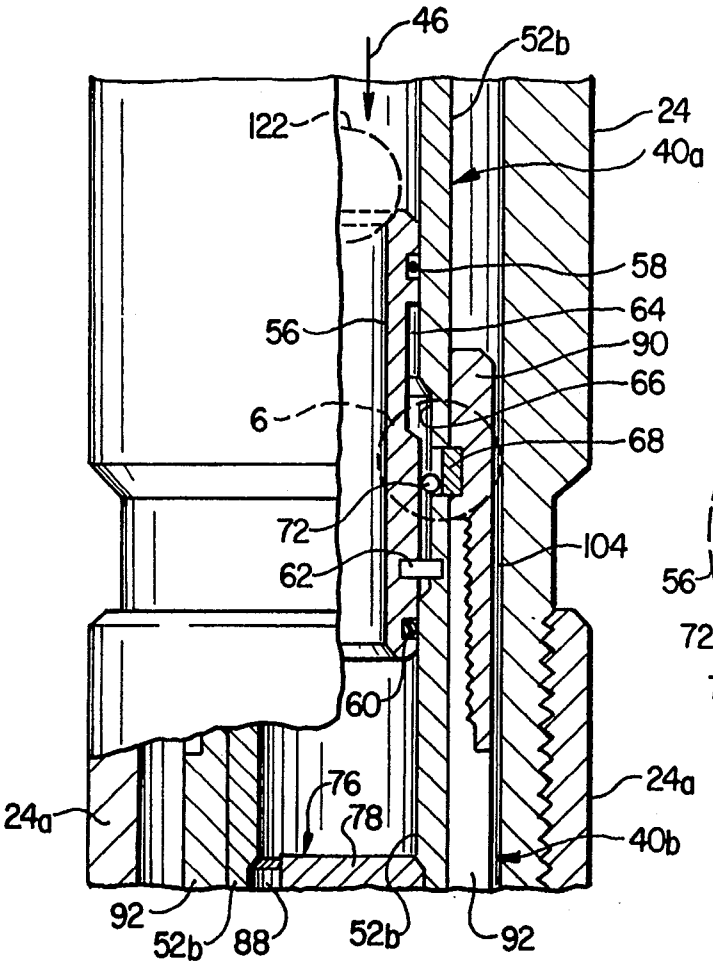

Breakage of the shear pins 62 permits the piston 56 to be fluid driven downwardly toward the upper flow sub member end portion 78, as indicated by the arrow 124 in FIG. 5B, thereby causing the annular exterior piston recess 64 into a facing relationship with the annular interior side surface recess 66 of the lower round box member end portion **52*b*. In turn, this permits the radially outwardly expanded lug member 68 to snap inwardly into and fully enter the annular exterior box member notch 70, as indicated by the dotted line position of the lug member 68 in FIG. 6, driving the metal balls 72 through their associated holes 74 into the piston recess 64**.

The full entry of the lug member 68 into the annular notch 70 frees the recirculating tool **40*a* from the sealing and tubing extension structure 40*b* and permits the recirculating tool 40*a* to be pulled upwardly through the production tubing 24 on the coil tubing 42, as indicated in FIG. 1C, and removed from the production tubing. Production fluid F may then flow upwardly through the sealing and tubing extension structure 40*b*** as also indicated in FIG. 1C.

When the piston 56 is driven downwardly as just described, the upper piston seal 58 is brought downwardly past the upper end of the annular recess 66, thereby permitting the fluid being pumped downwardly into the round box member 52 to leak past the upper end of the downwardly shifted piston 56 and into the annular passage 104 via the ball holes 74. This fluid leakage past the piston 56 creates a pressure drop in the fluid being pumped down the coil tubing 42, thus signaling the operator that the shear pins 62 have been broken and the recirculating tool **40*a* has been unlatched from the sealing and tubing extension structure 40*b***.

The ability, provided by the latching structure described above, to separate the recirculating tool **40*a* from the sealing and tubing extension structure 40*b* and remove the tool 40*a* from the production tubing 24 is particularly useful in the event that the sealing and tubing extension structure 40*b* becomes stuck to the production tubing after the recirculation process has been completed. However, in certain applications it may not be necessary or desirable to separate the recirculating tool 40*a* from the sealing and tubing extension structure 40*b*, and the entire recirculating tool assembly 40 may be pulled out of the production tubing 24, on the coil tubing 42**, without operating the latch mechanism.

Alternate Structure and Use of the Recirculating Tool Assembly 40

Figure 3:
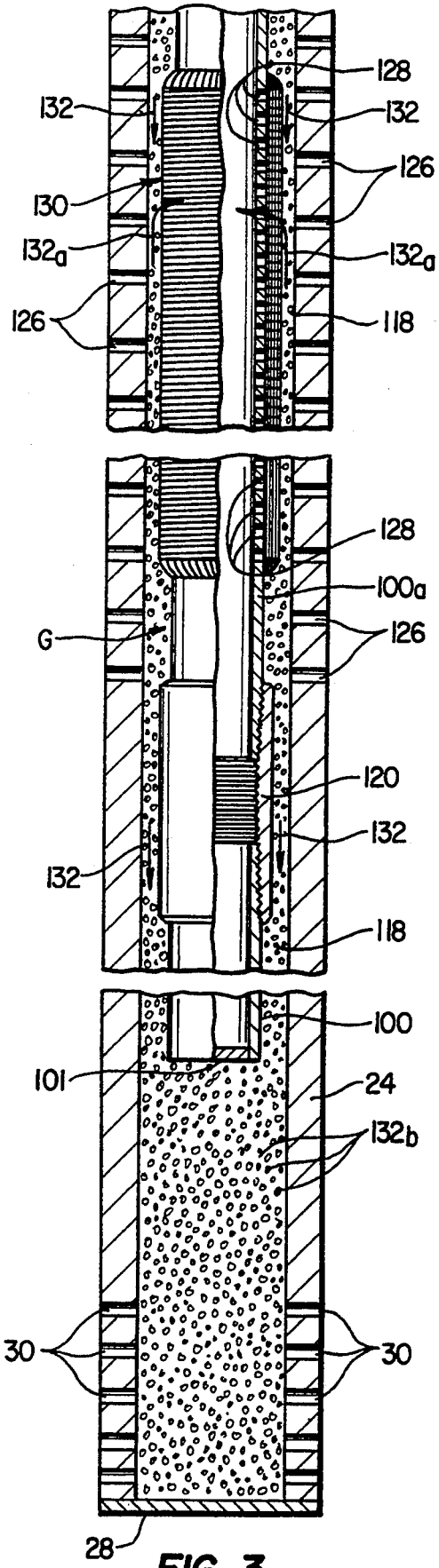
FIG. 3 is a cross-sectional view similar to that in FIG. 2C, but illustrating a modified lower end portion of the recirculating tool assembly used in an alternative method of restoring production fluid inflow into the production tubing.

In using the recirculating tool assembly 40 to carry out the production fluid flow restoration method described above, the recirculation fluid 46 is used to unblock the obstructed perforations 30 at the lower end of the production tubing 24 to permit production fluid to once again flow inwardly through the perforations 30 for delivery to the surface through the production tubing. An alternative method of restoring production fluid inflow to the production tubing 24 when its perforations 30 become obstructed is illustrated in FIG. 3.

In this alternative flow restoration method additional perforations 126 are formed in the production tubing 24, above its obstructed perforations 30, prior to the lowering of the recirculating tool assembly 40 into the production tubing 24 on the coil tubing 42. These additional perforations 126 may be formed using a conventional perforation gun (not illustrated) lowered into the production tubing and then removed therefrom prior to the installation of the recirculating tool assembly.

Prior to lowering the recirculating tool assembly 40 into the production tubing 24 a tubing section **100*a* is installed in the previously described tubing section 100 using collars 120. Tubing section 100*a* has perforations 128 formed therein, and a conventional tubular sand filter structure 130 is installed on the tubing section 100*a* over its perforations 128. Additionally, the lower end of the tubing section 100 is capped off as at 101. As illustrated in FIG. 3, the sand filter 130 has an outer diameter less than the inner diameter of the production tubing 24. Accordingly, the previously mentioned annular flow passage 118 extends downwardly past the sand filter. When the modified recirculating tool assembly 40 is lowered into the production tubing as described above, the sand filter 130 is positioned generally at the newly formed production tubing perforations 126, and the open lower end of the tubing section 100 is disposed above the obstructed production tubing perforations 30**.

After the recirculating tool assembly has been lowered into place within the production tubing 24, a slurry 132 of recirculating fluid 132*a* and gravel packing material 132*b* is pumped downwardly through the coil tubing 42 and the modified recirculating tool assembly, and flows, via the annular passage 118, into the bottom of the production tubing 24. As illustrated in FIG. 3, the gravel portion 32*b* of the slurry 32 fills the lower end of the production tubing 24 and the annular passage 118, and the liquid portion 132*a* of the slurry 132 is forced inwardly through the sand filter 130. The liquid slurry portion 132*a* then flows upwardly through the tool assembly and into the coil tubing annulus 44 for return to the surface.

When this recirculating flow process is completed, and the recirculating tool 40*a* is unlatched from the sealing and tubing extension structure 40*b* and removed from the production tubing 24, a gravel pack G remains in place around the sand filter 130. Production fluid can then flow inwardly through the perforations 126, the gravel pack G, and the sand filter 130 into the tubing section 100*a* for delivery to the surface as previously described. Production fluid can also enter the production tubing 24 through any of the perforations 30 which have been cleared by this recirculation process and flow through the lower end of the gravel pack G and upwardly to and then into the sand filter 130.

The foregoing detailed description is to be clearly understood as being given by way of illustration and example only, the spirit and scope of the present invention being limited solely by the appended claims.

What is claimed is:

1. A method of restoring production fluid inflow through obstructed perforations in the production tubing portion of a subterranean well completion, said method comprising the steps of:

providing a recirculating tool;

connecting said recirculating tool to an end of tubing means having an outer diameter less than the inner diameter of the production tubing;

lowering said recirculating tool into the production tubing, on said tubing means, to a position above the obstructed production tubing perforations;

unblocking the obstructed perforations by the steps of:

flowing a recirculation fluid downwardly through said tubing means and a first portion of said recirculating tool, and discharging the fluid downwardly into the production tubing beneath said recirculating tool, forcing a first portion of the discharged recirculation fluid outwardly through the obstructed perforations to unblock them, and flowing a second portion of the discharged recirculation fluid upwardly through a second portion of said recirculating tool into the production tubing externally around said tubing means;

removing said recirculating tool from the production tubing; and permitting production fluid to flow into the unblocked perforations and upwardly through the production tubing.

2. The method of claim 1 wherein:

said providing step is performed by providing a recirculating tool assembly in which a lower portion of said recirculating tool is releasably locked to a hollow sealing and tubing extension structure, said lowering step includes the step of bringing said sealing and tubing extension structure into a sealed, supported relationship within the production tubing, said steps of flowing a recirculation fluid and flowing a second portion of the discharged recirculation fluid are performed by:

flowing the recirculation fluid downwardly through said tubing means and a first portion of said recirculating tool assembly, and discharging the recirculation fluid downwardly into the production tubing beneath said sealing and tubing extension structure, and flowing the second portion of the discharged recirculation fluid upwardly through a second portion of said recirculating tool assembly into the production tubing externally around said tubing means, and said method further comprises the step of unlocking said recirculating tool from said sealing and tubing extension structure prior to removing said recirculating tool from the production tubing, whereby said sealing and tubing extension structure is left in the production tubing after removal of said recirculating tool therefrom, and said permitting step includes the step of permitting production fluid to flow upwardly through said sealing and tubing extension structure.

3. The method of claim 2 wherein:

said unlocking step is performed utilizing fluid pressure within said tubing means.

4. The method of claim 3 wherein:

said recirculating tool has a lower portion telescopingly received within said sealing and tubing extension structure and releasably latched thereto by a retractable lug member, said recirculating tool has a hollow, open-ended tubular piston member slidably received therein and releasably anchored thereto by frangible means, and said unlocking step is performed by the step of exerting downward fluid pressure on said piston member in a manner breaking said frangible means, downwardly shifting said piston member within said recirculating tool, and responsively causing the retraction of said lug member to release said recirculating tool from said sealing and tubing extension structure.

5. The method of claim 4 wherein said step of exerting downward fluid pressure on said piston member includes the steps of:

dropping a ball member on an upper end of said piston member into fluid sealing engagement therewith, and exerting a downward fluid pressure on said ball member.

6. The method of claim 2 wherein:

said step of flowing the recirculation fluid downwardly is performed by sequentially flowing the recirculation fluid downwardly through said tubing means, through the interior of said recirculating tool, laterally outwardly through said sealing and tubing extension structure, and then downwardly past said sealing and tubing extension structure between said sealing and tubing extension structure and the interior surface of the production tubing, and said step of flowing the second portion of the discharged recirculation fluid upwardly is performed by sequentially flowing said second portion of the discharged recirculation fluid upwardly through the interior of said sealing and tubing extension structure, laterally outwardly through said recirculating tool assembly, and then upwardly between said recirculating tool assembly and the interior surface of the production tubing.

7. The method of claim 1 wherein:

said providing step is performed by providing a recirculating tool assembly in which a lower portion of said recirculating tool is releasably locked to a hollow sealing and tubing extension structure, said lowering step includes the step of bringing said sealing and tubing extension structure into a sealed, supported relationship within the production tubing, said steps of flowing a recirculation fluid and flowing a second portion of the discharged recirculation fluid are performed by:

flowing the recirculation fluid downwardly through said tubing means and a first portion of said recirculating tool assembly, and discharging the recirculation fluid downwardly into the production tubing beneath said sealing and tubing extension structure, and flowing the second portion of the discharged recirculation fluid upwardly through a second portion of said recirculating tool assembly into the production tubing externally around said tubing means, and said step of removing said recirculating tool from the production tubing is performed by removing said recirculating tool assembly from the production tubing on said tubing means.

8. For use in conjunction with a subterranean well completion having obstructed production fluid inlet perforations in its production tubing portion, a method of restoring production fluid inflow into the production tubing, said method comprising the steps of:

forming additional production fluid inlet perforations in the production tubing;

providing a recirculating tool assembly including an upper recirculating tool portion releasably locked to a hollow, lower sealing and tubing extension structure having external annular sealing means thereon and a perforated tube area circumscribed by a sand screen structure;

connecting said upper recirculating tool portion to an end of tubing means having an outer diameter less than the inner diameter of the production tubing;

lowering said recirculating tool assembly into the production tubing, on said tubing means, to a position therein in which said lower sealing and tubing extension structure is supported on a portion of the production tubing, said sealing means are in sealing engagement with the interior surface of the production tubing, and said sand screen structure is vertically adjacent said additional production fluid inlet perforations;

forming a gravel pack between said additional production fluid inlet perforations and said sand screen structure by flowing a fluid/gravel packing material slurry downwardly through said tubing means and a first portion of said recirculating tool assembly into the production tubing and flowing a recirculated fluid portion of said slurry upwardly through a second portion of said recirculating tool assembly;

unlocking said upper recirculating tool portion from said lower sealing and tubing extension structure;

pulling the unlocked upper recirculating tool portion out of the production tubing on said tubing means and leaving said lower sealing and tubing extension structure in place within the production tubing; and permitting production fluid to flow sequentially through said additional production fluid inlet perforations, said gravel pack structure, said sand screen structure, said perforated tube area of said lower sealing and tubing extension structure, and upwardly through said lower sealing and tubing extension structure into the production tubing for delivery to the surface of the well completion.

9. The method of claim 8 wherein:

said unlocking step is performed utilizing fluid pressure within said tubing means.

10. The method of claim 9 wherein:

said upper recirculating tool portion has a lower portion telescopingly received within said lower sealing and tubing extension structure and releasably latched thereto by a retractable lug member, said upper recirculating tool portion has a hollow, open-ended tubular piston member slidably received therein and releasably anchored thereto by frangible means, and said unlocking step is performed by the step of exerting downward fluid pressure on said piston member in a manner breaking said frangible means, downwardly shifting said piston member within said recirculating tool, and responsively causing the retraction of said lug member to release said upper recirculating tool portion from said lower sealing and tubing extension structure.

11. The method of claim 10 wherein said step of exerting downward fluid pressure on said piston member includes the steps of:

dropping a ball member on an upper end of said piston member into fluid sealing engagement therewith, and exerting a downward fluid pressure on said ball member.

12. The method of claim 8 wherein said step of forming a gravel pack is performed by:

sequentially flowing said slurry downwardly through said tubing means, through the interior of said upper recirculating tool portion, laterally outwardly through said lower sealing and tubing extension structure, and then downwardly past said lower sealing and tubing extension structure between said lower sealing and tubing extension structure and the interior surface of the production tubing, and sequentially flowing said recirculated fluid portion of said slurry upwardly through the interior of said lower sealing and tubing extension portion, laterally outwardly through said recirculating tool assembly, and then upwardly between said recirculating tool assembly and the interior surface of the production tubing.

13. A recirculating tool assembly for use in restoring production fluid flow into a subterranean well completion production tubing structure having obstructed production fluid inlet perforations, said recirculating tool assembly being lowerable into the production tubing structure, on an end of tubing means having an outer diameter less than the inner diameter of the production tubing structure, to a predetermined position therein relative to the obstructed inlet perforations, said recirculating tool assembly comprising:

a hollow upper recirculating tool portion securable to said end of said tubing means;

a hollow lower sealing and tubing extension structure having support means thereon for engaging an interior portion of the production tubing and supporting said sealing and tubing extension structure at said predetermined position, and seal means for engaging the interior surface of the production tubing structure and forming an annular seal around said sealing and tubing extension structure;

latch means for releasably locking said upper recirculating tool portion to said lower sealing and tubing extension structure;

first wall means for defining a first flow path through which a fluid within said tubing means may be flowed downwardly through said recirculating tool assembly and discharged therefrom;

second wall means for defining a second flow path, isolated from said first flow path, through which a portion of the discharged fluid may be returned upwardly through said recirculating tool assembly and discharged therefrom; and fluid pressure operable means, disposed in said first flow path, for unlocking said latch means and freeing said upper recirculating tool portion from said lower sealing and tubing extension structure.

14. The recirculating tool assembly of claim 13 wherein:

a lower portion of said recirculating tool portion is telescopingly received in an upper portion of said lower sealing and tubing extension structure and releasably locked therein by said latch means.

15. The recirculating tool assembly of claim 14 wherein said fluid pressure operable means include:

hollow tubular piston means slidably received in said upper recirculating tool portion, in said first flow path, and releasably locked to said upper recirculating tool portion by frangible means, said piston means, in response to a downward fluid pressure force exerted thereon, being operative to break said frangible means, move downwardly in said first flow path, and responsively cooperate with said latch means in a manner causing said latch means to release said upper recirculating tool portion from said lower sealing and tubing extension structure.

16. The recirculating tool assembly of claim 15 wherein:

said piston means have an annular external side surface recess thereon, said upper recirculating tool portion has an annular external side surface notch and a side wall opening extending inwardly from said annular notch and opposing an external side surface portion of said piston means disposed beneath said external side surface recess therein, said lower sealing and tubing extension structure has an annular interior side surface notch facing said annular exterior side surface notch of said upper recirculating tool portion, and said latch means include an annular split lug member having a radially inner side portion received in said annular external side surface notch of said upper recirculating tool portion, and a radially outer side portion received in said annular internal side surface notch of said lower sealing and tubing extension structure, said lug member being resiliently and radially outwardly deflected by a ball member received in said side wall opening and bearing against said external side surface portion of said piston means and the inner side surface of said lug member, said ball member being drivable through said side wall opening, into said piston means external side surface recess by said lug member, when said piston means are downwardly moved relative to said upper recirculating tool portion, in a manner withdrawing said lug member from said internal side surface notch of said lower sealing and tubing extension structure.

17. The recirculating tool assembly of claim 13 wherein:

said first flow path sequentially extends downwardly through a central upper end portion of said recirculating tool assembly, laterally outwardly through said recirculating tool assembly, and then downwardly along an external side surface of said recirculating tool assembly past a lower end thereof, and said second flow path sequentially extends upwardly through a central lower end portion of said recirculating tool assembly, laterally outwardly through said recirculating tool assembly, and then upwardly along an external side surface of said recirculating tool assembly past an upper end portion thereof.

18. The recirculating tool assembly of claim 13 wherein:

said lower sealing and tubing extension structure has a perforated tube section therein outwardly circumscribed by an annular sand screen structure.

19. The recirculating tool assembly of claim 13 wherein:

said support means include an annular external shoulder surface formed on said lower sealing and tubing extension structure.

20. A recirculating tool assembly for use in restoring production fluid flow into a subterranean well completion production tubing structure having obstructed production fluid inlet perforations, said recirculating tool assembly being lowerable into the production tubing structure, on an end of tubing means having an outer diameter less than the inner diameter of the production tubing structure, to a predetermined position therein relative to the obstructed inlet perforations, said recirculating tool assembly comprising:

a hollow upper recirculating tool portion securable to said end of said tubing means;

a hollow lower sealing and tubing extension structure having support means thereon for engaging an interior portion of the production tubing and supporting said sealing and tubing extension structure at said predetermined position, and seal means for engaging the interior surface of the production tubing structure and forming an annular seal around said sealing and tubing extension structure, a lower portion of said recirculating tool portion being telescopingly received in an upper portion of said sealing and tubing extension structure;

latch means for releasably interlocking the telescoped portions of said upper recirculating tool portion and said lower sealing and tubing extension structure;

first wall means for defining a first flow path through which a fluid within said tubing means may be flowed downwardly through said recirculating tool assembly and discharged therefrom;

second wall means for defining a second flow path, isolated from said first flow path, through which a portion of the discharged fluid may be returned upwardly through said recirculating tool assembly and discharged therefrom; and fluid pressure operable means, disposed in said first flow path, for unlocking said latch means and freeing said upper recirculating tool portion from said lower sealing and tubing extension structure, said fluid pressure operable means including hollow tubular piston means slidably received in said upper recirculating tool portion and releasably locked to said upper recirculating tool portion by frangible means, said piston means, in response to a downward fluid pressure force exerted thereon, being operative to break said frangible means, move downwardly in said first flow path, and responsively cooperate with said latch means in a manner causing said latch means to release said upper recirculating tool portion from said lower sealing and tubing extension structure.

21. The recirculating tool assembly of claim 20 wherein:

said piston means have an annular external side surface recess thereon, said upper recirculating tool portion has an annular external side surface notch and a side wall opening extending inwardly from said annular notch and opposing an external side surface portion of said piston means disposed beneath said external side surface recess therein, said lower sealing and tubing extension structure has an annular interior side surface notch facing said annular exterior side surface notch of said upper recirculating tool portion, and said latch means include an annular split lug member having a radially inner side portion received in said annular external side surface notch of said upper recirculating tool portion, and a radially outer side portion received in said annular internal side surface notch of said lower sealing and tubing extension structure, said lug member being resiliently and radially outwardly deflected by a ball member received in said side wall opening and bearing against said external side surface portion of said piston means and the inner side surface of said lug member, said ball member being drivable through said side wall opening, into said piston means external side surface recess by said lug member, when said piston means are downwardly moved relative to said upper recirculating tool portion, in a manner withdrawing said lug member from said internal side surface notch of said lower sealing and tubing extension structure.

22. The recirculating tool assembly of claim 21 wherein:

said first flow path sequentially extends downwardly through a central upper end portion of said recirculating tool assembly, laterally outwardly through said recirculating tool assembly, and then downwardly along an external side surface of said recirculating tool assembly past a lower end thereof, and said second flow path sequentially extends upwardly through a central lower end portion of said recirculating tool assembly, laterally outwardly through said recirculating tool assembly, and then upwardly along an external side surface of said recirculating tool assembly past an upper end portion thereof.

23. The recirculating tool assembly of claim 22 wherein:

said lower sealing and tubing extension structure has a perforated tube section therein outwardly circumscribed by an annular sand screen structure.

24. The recirculating tool assembly of claim 20 wherein:

said support means include an annular external shoulder surface formed on said lower sealing and tubing extension structure.

* * * * *